US008065775B2

(12) United States Patent
Cameneti et al.

(10) Patent No.: US 8,065,775 B2
(45) Date of Patent: Nov. 29, 2011

(54) MOP CONVENIENT FOR THE REPLACEMENT OF THE CONSUMPTIVE MATERIAL

(76) Inventors: Michael Alan Cameneti, Van Nuys, CA (US); Robson L. Splane, Jr., Valley Center, CA (US)

( * ) Notice: Subject to any disclaimer, the term of this patent is extended or adjusted under 35 U.S.C. 154(b) by 589 days.

(21) Appl. No.: 12/289,416

(22) Filed: Oct. 28, 2008

(65) Prior Publication Data

US 2010/0101039 A1 Apr. 29, 2010

(51) Int. Cl.
*A47L 13/20* (2006.01)

(52) U.S. Cl. ..... 15/228; 15/150; 15/147.1; 15/147.2

(58) Field of Classification Search ..... 15/118, 15/147.1, 147.2, 228, 244.2, 150; *A47L 13/20*
See application file for complete search history.

(56) References Cited

U.S. PATENT DOCUMENTS 3,324,495 A * 6/1967 Van Schwartz ..... 15/147.2
5,099,539 A * 3/1992 Forester ..... 15/144.3
5,218,734 A * 6/1993 Sacks ..... 15/147.2
5,253,387 A * 10/1993 Kresse et al. ..... 15/228
5,390,390 A * 2/1995 Kresse et al. ..... 15/228
5,483,720 A * 1/1996 Decoopman et al. ..... 15/119.2
5,487,202 A * 1/1996 Cowan ..... 15/228
5,836,039 A * 11/1998 Rimer ..... 15/228
5,864,914 A * 2/1999 Salmon ..... 15/147.2
5,926,896 A * 7/1999 Allemann et al. ..... 15/147.2
5,937,471 A * 8/1999 Liao ..... 15/111
5,970,567 A * 10/1999 Hirse ..... 15/229.2
RE36,635 E * 4/2000 Vosbikian et al. ..... 15/119.2
6,260,226 B1 * 7/2001 Specht ..... 15/119.1
6,687,943 B2 * 2/2004 Zorzo ..... 15/228
7,039,969 B2 * 5/2006 Zorzo ..... 15/147.1
7,124,464 B2 * 10/2006 Williams et al. ..... 15/115
7,178,189 B1 * 2/2007 Perry et al. ..... 15/119.2
7,257,853 B2 * 8/2007 Boyer et al. ..... 15/119.2
7,530,139 B2 * 5/2009 Niemeyer et al. ..... 15/228
7,854,035 B2 * 12/2010 Gullicks et al. ..... 15/147.1
2007/0220693 A1 * 9/2007 Billig et al. ..... 15/104.94

* cited by examiner

*Primary Examiner* — Monica Carter
*Assistant Examiner* — Michael Jennings
(74) *Attorney, Agent, or Firm* — Risso & Associates; Marcus Risso

(57) ABSTRACT

A mop includes a molded mop casing having two mophead supporting faces connected together to show a double beveled configuration, a detached part pivotally connected to the molded mop casing between the mophead supporting faces, a mop shaft connected to the detached part and biasable with the mop shaft relative to the molded mop casing, a handle coupled to the mop shaft and movable forwards/backwards along the mop shaft, and an extending device mounted in the handle and the molded mop casing and movable by the handle between an extended position and a received position for locking/unlocking a consumptive material for enabling a user to mount/dismount the consumptive material conveniently without direct hand contact.

3 Claims, 7 Drawing Sheets

MOP CONVENIENT FOR THE REPLACEMENT OF THE CONSUMPTIVE MATERIAL

BACKGROUND OF THE INVENTION

1. Field of the Invention

The present invention relates to cleaning apparatus and more particularly, to a mop that facilitates replacement of the consumptive material.

2. Description of the Related Art

Cleaning work is a troublesome job with high contamination potential. Many cleaning products are commercially available, and specifically designed for cleaning floor, window, barbecue grill, or other purposes. Newly designed cleaning products facilitate the cleaning work. However, when using water basket with a mop to perform a cleaning work, a user cannot avoid direct contact of the hands with the mophead. When twisting the mophead to dry the mophead, the hands may be contaminated with dirts. Further, these cleaning products are commonly limited to a specific field for a specific application.

SUMMARY OF THE INVENTION

The present invention has been accomplished under the circumstances in view. It is the main object of the present invention to provide a mop, which facilitates replacement of the consumptive material. It is another object of the present invention to provide a mop, which avoids direct contact of the hand with the consumptive material when replacing the consumptive material.

To achieve these and other objects of the present invention, the mop comprises a molded mop casing, which has two mophead supporting faces connected together to show a double beveled configuration, a detached part pivotally connected to the molded mop casing between the mophead supporting faces, a mop mop shaft, which has a front end connected to the detached part for enabling the mop shaft to be biased with the detached part relative to the molded mop casing, a handle coupled to the mop shaft and movable forwards/backwards along the mop shaft, and an extending device mounted in the handle and the molded mop casing and movable by the handle between an extended position and a received position for locking/unlocking a consumptive material.

DETAILED DESCRIPTION OF THE INVENTION

Figure 1:
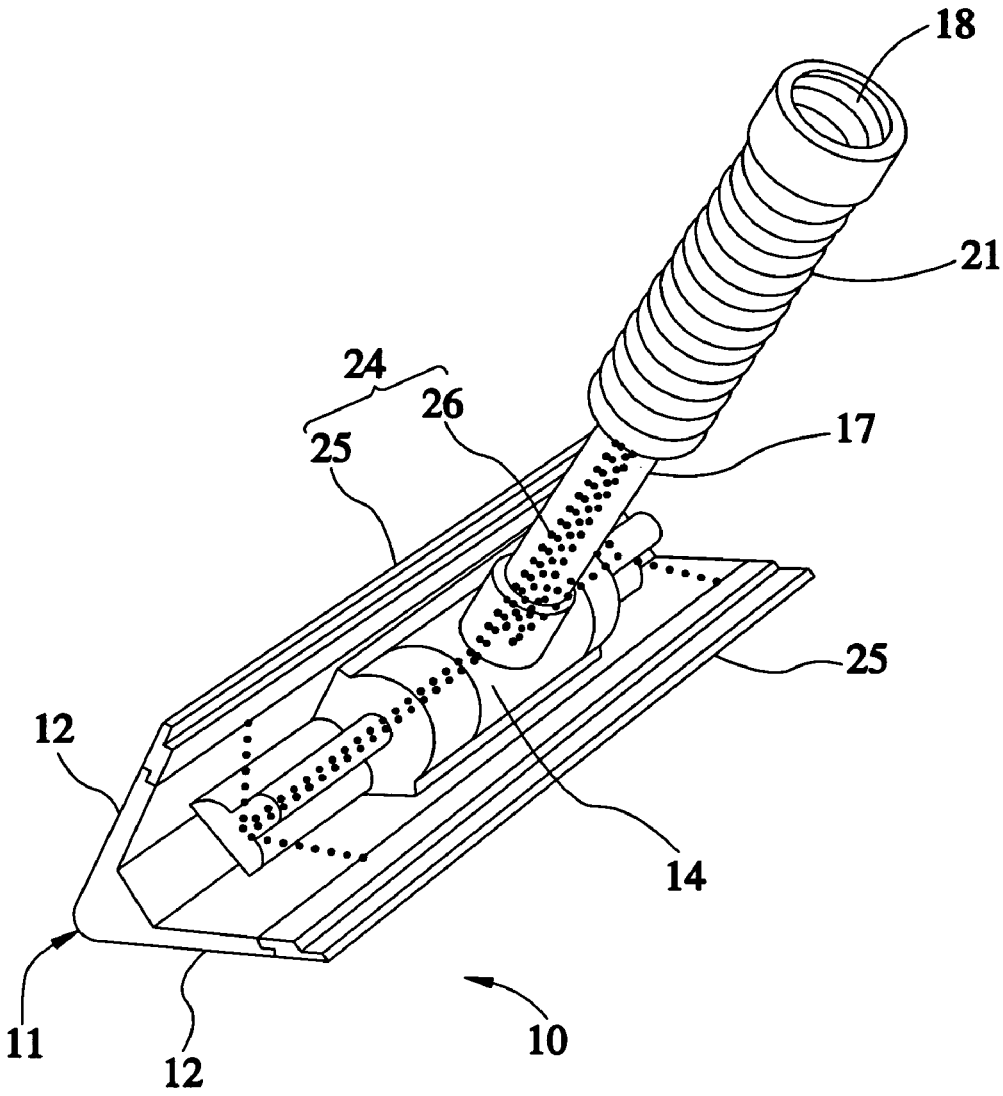
FIG. 1 is a perspective view of a mop in accordance with a first embodiment of the present invention (the consumptive material excluded).
Figure 2:
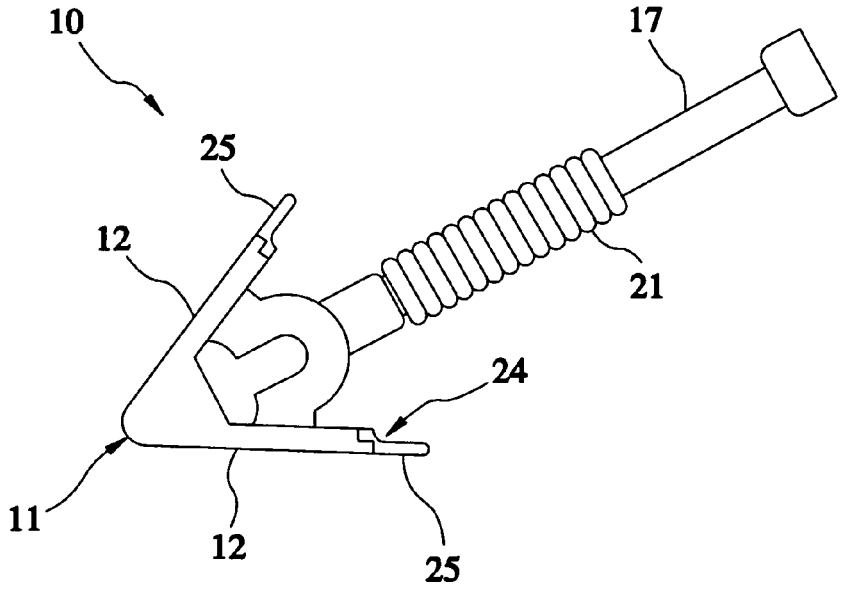
FIG. 2 is a schematic drawing of the first embodiment of the present invention, showing the retaining strips in the received position.
Figure 3:
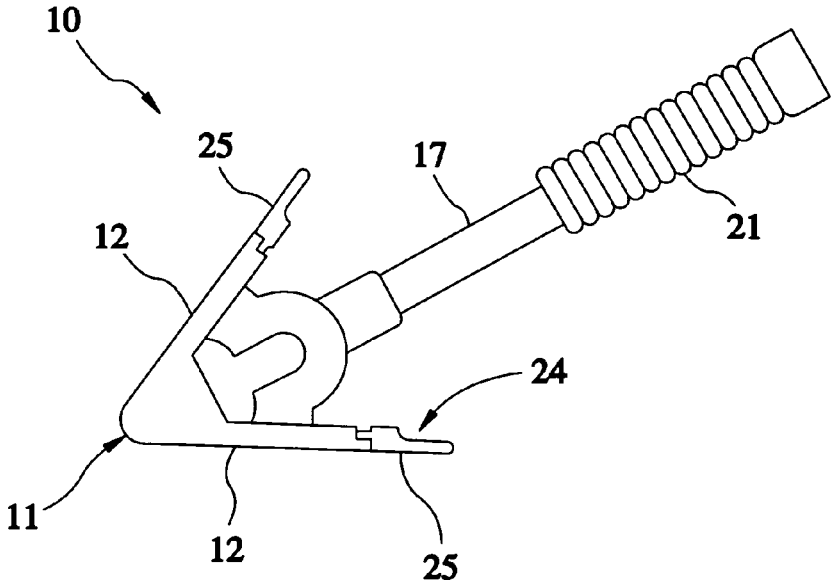
FIG. 3 corresponds to FIG. 2, showing the retaining strips in the extended position.

Referring to FIGS. 1~3, a mop 10 in accordance with a first embodiment of the present invention is shown comprising: a molded mop casing 11, a detached part 14, a mop shaft 17, a handle 21, and an extending device 24.

The molded mop casing 11 is a double-beveled hollow member showing a V-shaped cross section, having two mophead supporting faces 12 that have the respective bottom edge formed integral with each other.

The detached part 14 is pivotally coupled to the molded mop casing 11.

The shaft 17 is a tubular member connected with its front end to the detached part 14. By means of the detached part 14, the mop shaft 17 is biasable relative to the molded mop casing 11. The mop shaft 17 has a threaded female cavity 18 in its rear end for the connection of an external operating handle (not shown) to extend the length for convenient operation.

The handle 21 is a sleeve member sleeved onto the mop shaft 17 and axially movable along the length of the mop shaft 17.

The extending device 24 is connected between the handle 21 and the molded mop casing 11, and movable by the handle 21 to expand or retract the molded mop casing 11. According to this first embodiment, the extending device 24 comprises two retaining strips 25 and a plurality of activating cables/wires 26. The two retaining strips 25 are respectively coupled to the top sides of the two mophead supporting faces 12 and movable outwards/inwards by an external force. The activating cables/wires 26 are inserted through the mop shaft 17 into the inside of the molded mop casing 11, and respectively connected between the handle 21 and the two retaining strips 25. Thus, moving the handle 21 forwards/backwards along the mop shaft 17 causes the two retaining strips 25 to be moved outwards/inwards in two reversed directions.

Figure 4:
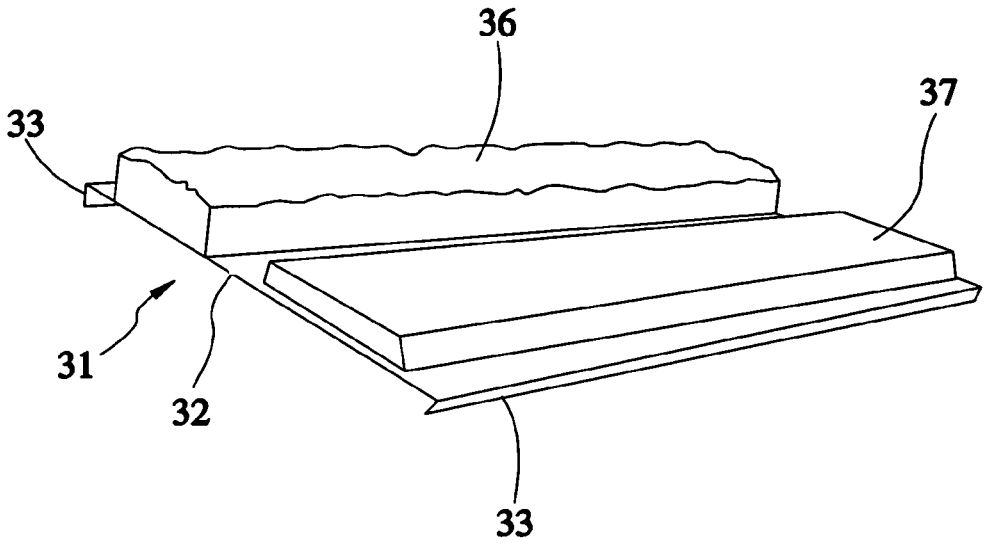
FIG. 4 is an elevational view of a consumptive material for use with the mop according to the first embodiment of the present invention.
Figure 5:
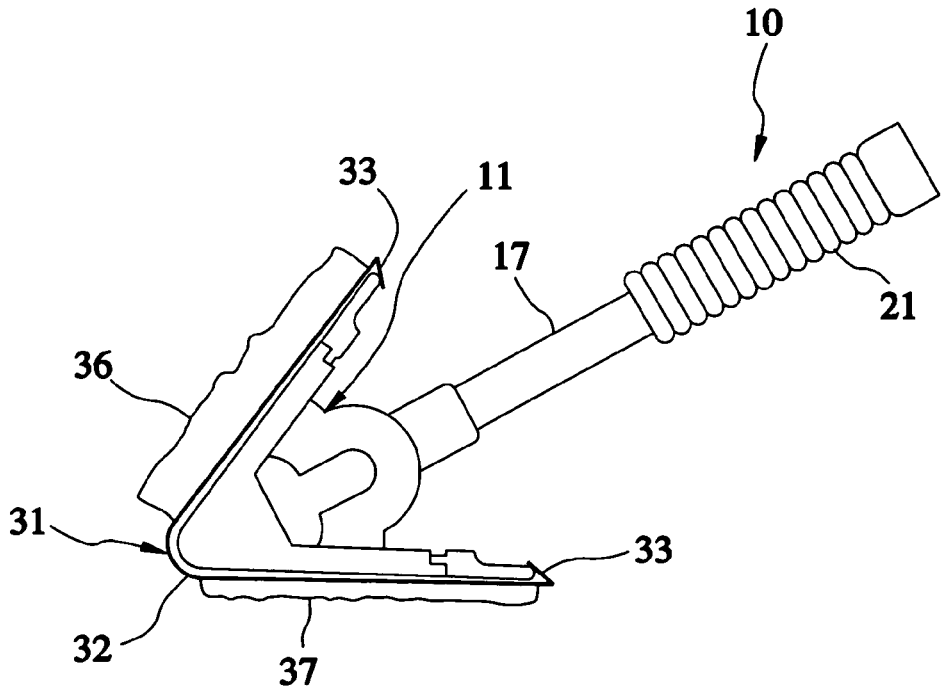
FIG. 5 is a schematic drawing of the first embodiment of the present invention, showing the consumptive material fastened to the molded mop casing.

During application, the mop 10 is used with a consumptive material, i.e., mophead 31. The mophead 31, as shown in FIG. 4, comprises a flexible sheet-like body 32, two anchoring means, for example, mop edges 33 respectively provided at two opposite sides of the flexible sheet-like body 32, and a dry type mophead element 36 and a wet type mophead element 37 provided at the outer wall of the flexible sheet-like body 32. As shown in FIG. 5, the flexible sheet-like body 32 is closely attached to the two mophead supporting faces 12 of the molded mop casing 11, and then the mop edges 33 are hooked edges respectively hooked on the two retaining strips 25 to secure the flexible sheet-like body 32 to the molded mop casing 11 firmly. Further, the dry type mophead element 36 can be, for example, a mop formed of a bundle of rags and, the wet type mophead element 37 can be a sponge filled with a detergent.

Thus, a user can operate the handle 21 to expand or retract the two retaining strips 25, thereby locking/unlocking the consumptive material 31. Therefore, a user can replace the consumptive material 31 rapidly without touching the mophead elements 36 and 37.

Figure 6:
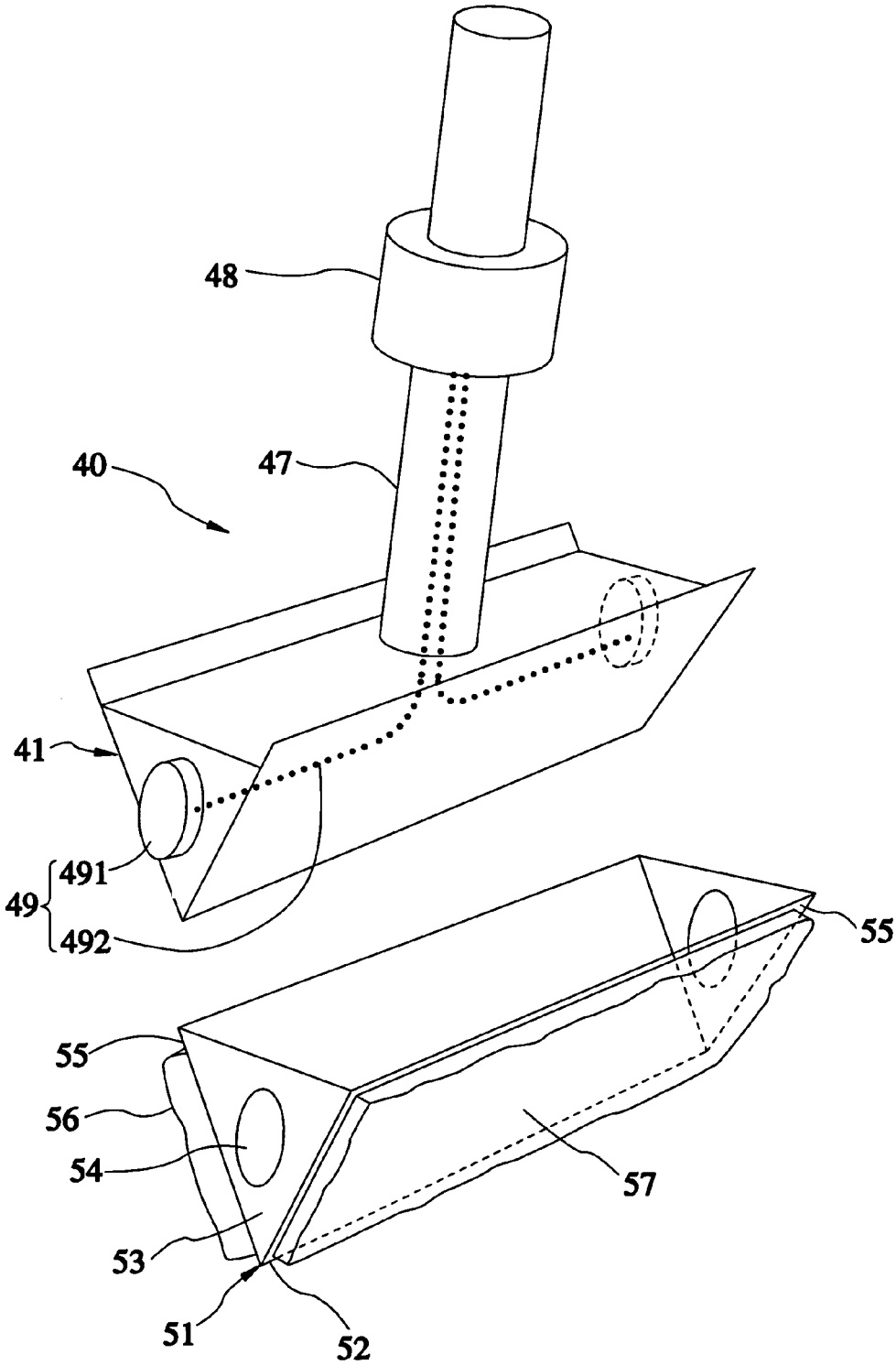
FIG. 6 is a perspective view of a mop in accordance with a second embodiment of the present invention before installation of the consumptive material.

FIG. 6 shows a mop in accordance with a second embodiment of the present invention. This second embodiment is substantially similar to the aforesaid first embodiment with the exception that the extending device 49 according to this second embodiment comprises two latch blocks 491 and a plurality of activating cables/wires 492. The two latch blocks 491 are respectively movably provided at the left and right sides of the molded mop casing 41 and movable inwards/outwards relative to the molded mop casing 41. The activating cables/wires 492 are inserted through the mop shaft 47 into the inside of the molded mop casing 41 and respectively connected to the latch blocks 491. Thus, a user can operate the handle 48 to move the latch blocks 491.

Further, the consumptive material, i.e., the mophead 51 according to this second embodiment comprises a hollow, double beveled body 52 that has two sidewalls 55, two end walls 53 connected between the two sidewalls 55 and a latch hole 54 in each side wall 55, a dry type mophead element 56 provided at one sidewall 55 of the body 52, and a wet type mophead element 57 provided at the other sidewall 55 of the body 52.

According to this second embodiment, a user can move the handle 48 forwards/backwards along the mop shaft 47 to move the two latch blocks 491 into or away from the latch holes 54 of the mophead 51, thereby locking the mophead 51 to the molded mop casing 41 or unlocking the mophead 51 from the molded mop casing 41.

Figure 7:
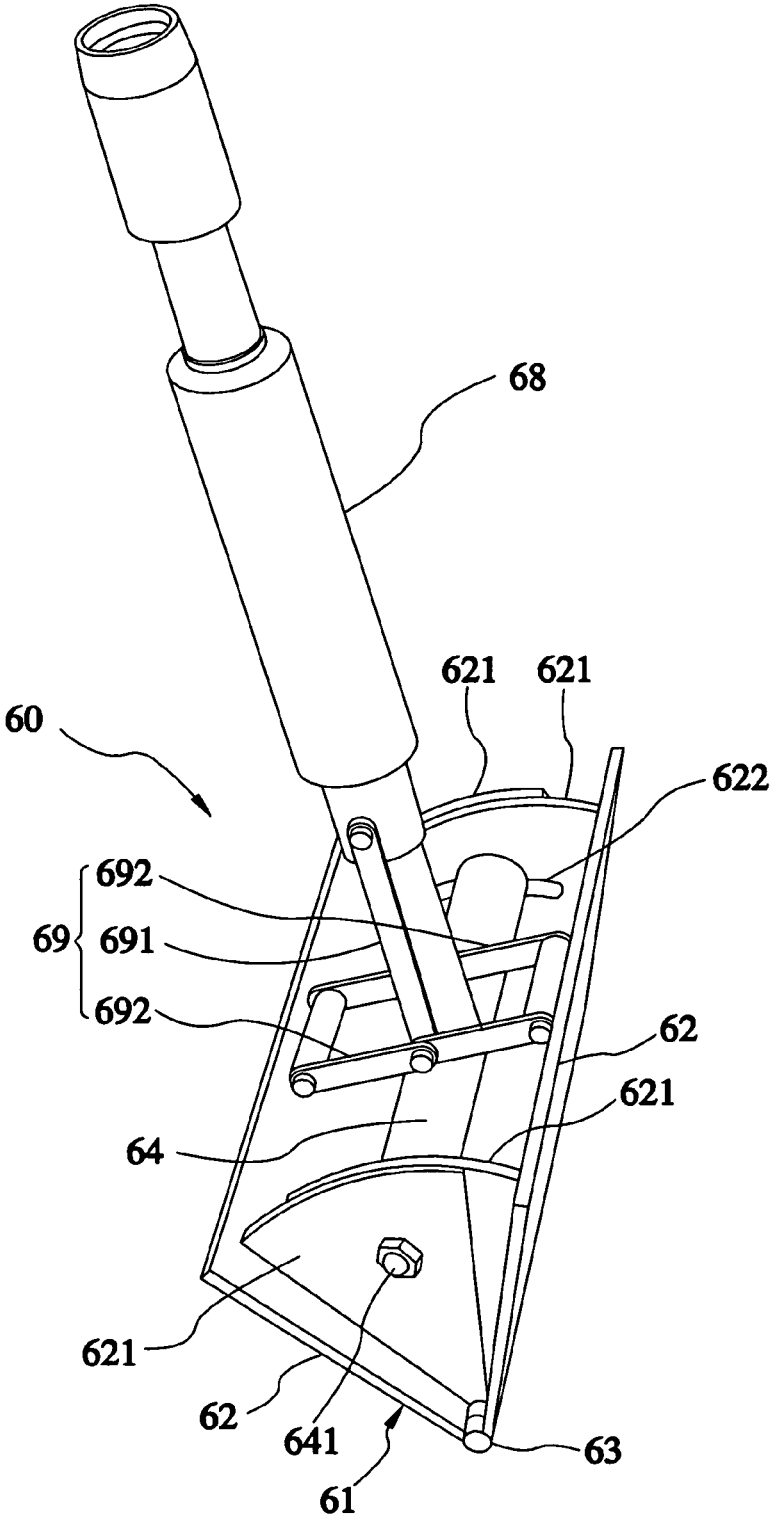
FIG. 7 is a perspective view of a mop in accordance with a third embodiment of the present invention (the consumptive material excluded).

FIG. 7 shows a mop 60 in accordance with a third embodiment of the present invention. This third embodiment is substantially similar to the aforesaid first embodiment with the exceptions as follows:

The molded mop casing 61 according to this third embodiment has the bottom edges of the two mophead supporting faces 62 hinged together by a hinge 63. Thus, the two mophead supporting faces 62 can be turned inwards/outwards relative to each other.

The extending device 69 comprises two rods/arms 691 and two movable links 692. The rods/arms 691 each have one end respectively pivotally connected to two opposite sides of the handle 68, and the other end respectively pivotally connected to the movable links 692. The two mophead supporting faces 62 each have two sector flanges 621 bilaterally protruded from the back side. The detached part 64 has two pivot pins 641 respectively extended from two sides thereof. The two pivot pins 641 are respectively inserted through an arched sliding slot 622 on each of the two sector flanges 621 of one mophead supporting face 62 and respectively affixed to the two sector flanges 621 of the other mophead supporting face 62.

According to this third embodiment, a user can operate the handle 6 to move the rods/arms 691, thereby swinging the mophead supporting faces 62 between an expanded position and a received position.

Figure 8:
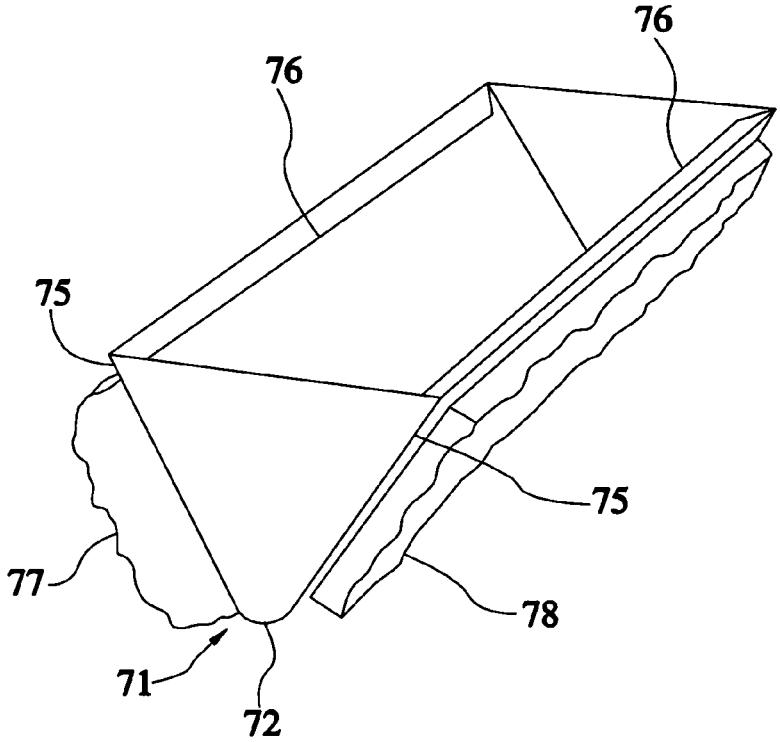
FIG. 8 is a perspective view of a consumptive material for use with the mop according to the third embodiment of the present invention.

Further, the consumptive material 71 according to this third embodiment, as shown in FIG. 8, comprises a hollow, double-beveled body 72 for capping onto the molded mop casing 61, and a dry type mophead element 77 and a wet type mophead element 78 respectively provided at the mophead supporting faces 75. The body 72 has a retaining portion 76 provided at the top side of each of the two mophead supporting faces 75. According to this embodiment, the retaining portion 76 is a hook flange protruded from the top side of each mophead supporting face 75.

When the two mophead supporting faces 75 are moved inwards to the received position, the consumptive material 71 can then be attached to the molded mop casing 61. When extending out the two mophead supporting faces 75, the mophead supporting faces 62 are respectively forced into engagement with the retaining portions 76. This third embodiment achieves the same effects as the aforesaid first embodiment.

Figure 9:
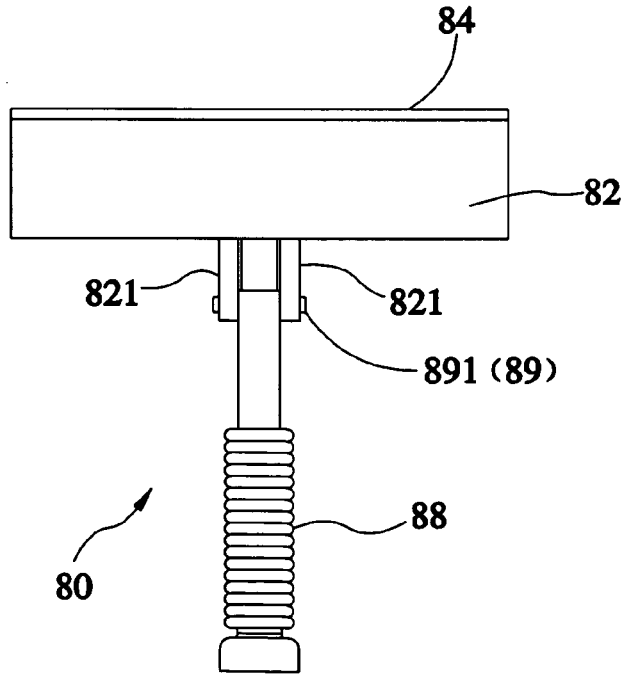
FIG. 9 is a front view of a mop in accordance with a fourth embodiment of the present invention (the consumptive material excluded).
Figure 10:
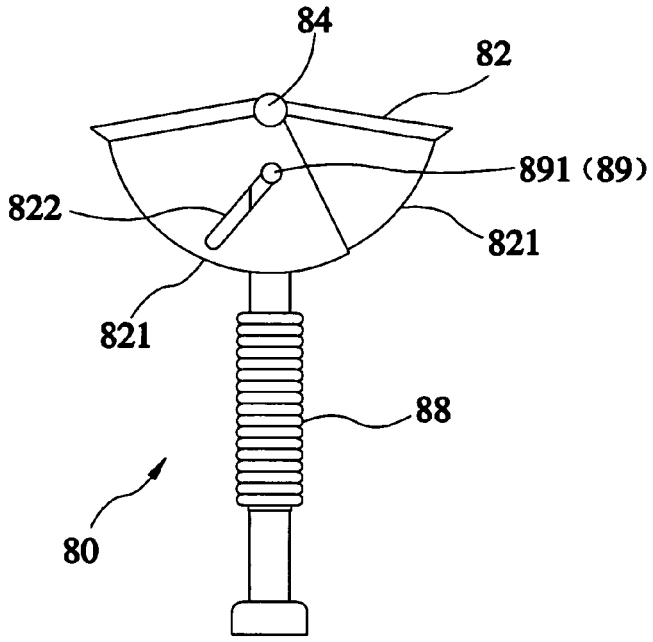
FIG. 10 is a side view of the mop in accordance with the fourth embodiment of the present invention (the consumptive material excluded).
Figure 11:
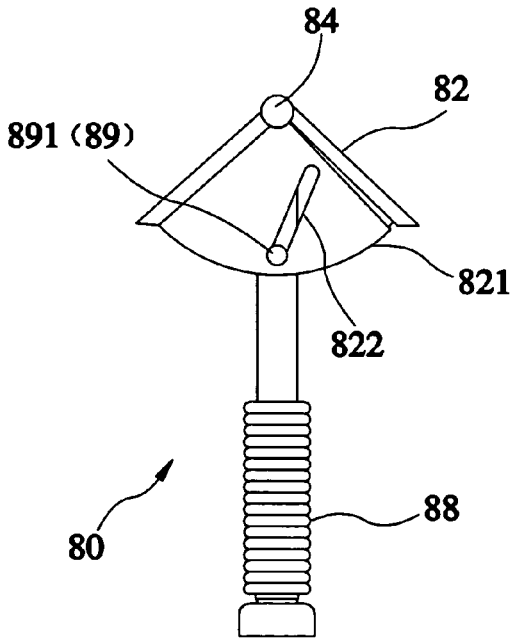
FIG. 11 corresponds to FIG. 11, showing the two mophead supporting faces of the molded mop casing in the received position.

FIGS. 9~11 show a mop 80 in accordance with a fourth embodiment of the present invention. This fourth embodiment is substantially similar to the aforesaid third embodiment with the exceptions as follows:

The detached part 84 is a hinge. The bottom edges of the two mophead supporting faces 82 of the molded mop casing 81 are respectively fastened to the detached part 84. Therefore, the two mophead supporting faces 82 can be turned relative to each other. Further, each mophead supporting face 82 has two sector flanges 821 bilaterally perpendicularly extended from the back side. Each sector flange 821 has an oblique sliding slot 822.

The extending device 89 comprises two pivot rods 891 respectively extended from two sides of the handle 88 and respectively inserted through the oblique sliding slots 822 on the sector flanges 821 of the mophead supporting faces 62.

Thus, a user can operate the handle 88 to move the pivot rods 891 in the oblique sliding slots 822, forcing the two mophead supporting faces 82 to move relative to the detached part 84 between the extended position and the received position.

The consumptive material 71 of the aforesaid third embodiment can be fastened to the molded mop casing 81 and used with this fourth embodiment, achieving the same effects as the aforesaid first embodiment.

In general, the invention provides a mop that has advantages and features as follows:

1. Ease of replacement of consumptive material: By means of operating the handle, the consumptive material can be locked/unlocked, facilitating replacement.

2. Hand contamination free: During replacement of the consumptive material, either mounting or dismounting the consumptive material, the user simply needs to operate the handle without touching the consumptive material, avoiding hand contamination.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A mop comprising:

a molded mop casing for holding a consumptive material, said molded mop casing comprising two mophead supporting faces connected together to show a double beveled configuration;

a detached part pivotally connected to said molded mop casing between said mophead supporting faces;

a mop shaft, said mop shaft comprising a front end connected to said detached part and enabling said mop shaft to be biased with said detached part relative to said molded mop casing;

a handle coupled to said mop shaft and movable forwards/backwards along said mop shaft;

an extending device mounted in said handle and said molded mop casing and movable by said handle between an extended position and a received position for locking/unlocking a consumptive material;

wherein said two mophead supporting faces are hinged together; and wherein said extending device comprises two rods/arms coupled between two sides of said handle and said two mophead supporting faces of said molded mop casing, and two movable links coupled between said mophead supporting faces; each said mophead supporting face comprising two sector flanges bilaterally perpendicularly extended from a back wall thereof, each sector flange of one said mophead supporting face having an arched sliding slot; said detached part comprises two pivot pins respectively extended from two opposite sides thereof and respectively inserted through the arched sliding slots of the sector flanges of one said mophead supporting face and respectively affixed to the sector flanges of the other said mophead supporting face.

2. A mop comprising:

a molded mop casing for holding a consumptive material, said molded mop casing comprising two mophead supporting faces connected together to show a double beveled configuration;

a detached part pivotally connected to said molded mop casing between said mophead supporting faces;

a mop shaft, said mop shaft comprising a front end connected to said detached part and enabling said mop shaft to be biased with said detached part relative to said molded mop casing:

a handle coupled to said mop shaft and movable forwards/backwards along said mop shaft;

an extending device mounted in said handle and said molded mop casing and movable by said handle between an extended position and a received position for locking/unlocking a consumptive material;

wherein said two mophead supporting faces are hinged together: and wherein said detached part is a hinge connected between a bottom edge of each said mophead supporting face; each said mophead supporting face comprising two sector flanges bilaterally perpendicularly extended from a back wall thereof, each said sector flange comprising an oblique sliding slot; said extending device comprises two pivot rods respectively extended from two sides of said handle and respectively inserted through the oblique sliding slots of the sector flanges of said mophead supporting faces.

3. A mop comprising:

a molded mop casing for holding a consumptive material, said molded mop casing comprising two mophead supporting faces connected together to show a double beveled configuration;

a detached part pivotally connected to said molded mop casing between said mophead supporting faces;

a mop shaft, said mop shaft comprising a front end connected to said detached part and enabling said mop shaft to be biased with said detached part relative to said molded mop casing;

a handle coupled to said mop shaft and movable forwards/backwards along said mop shaft;

an extending device mounted in said handle and said molded mop casing and movable by said handle between an extended position and a received position for locking/unlocking a consumptive material;

wherein said extending device comprises two latch blocks respectively mounted in two opposite lateral sides of said molded mop casing, and a plurality of activating cables/wires connected between said handle and said latch blocks and movable by said handle to move said latch blocks outwards/inwards relative to said molded mop casing between two positions; and a consumptive material comprising a hollow, double-beveled body capable onto said molded mop casing, said hollow, double-beveled body comprising two sidewalls corresponding to said mophead supporting faces, two end walls connected between said two sidewalls and a latch hole in each said side wall for receiving said latch blocks, a dry type mophead element provided at one said sidewall of said hollow, double-beveled body, and a wet type mophead element provided at the other sidewall of said hollow, double-beveled body.

* * * * *